US011275343B2

(12) United States Patent
Feyer

(10) Patent No.: US 11,275,343 B2
(45) Date of Patent: Mar. 15, 2022

(54) ADJUSTABLE TIMEPIECE ASSEMBLY

(71) Applicant: OMEGA SA, Biel/Bienne (CH)

(72) Inventor: Julien Feyer, Vernier (CH)

(73) Assignee: OMEGA SA, Biel/Bienne (CH)

( * ) Notice: Subject to any disclaimer, the term of this patent is extended or adjusted under 35 U.S.C. 154(b) by 672 days.

(21) Appl. No.: 16/211,277

(22) Filed: Dec. 6, 2018

(65) Prior Publication Data

US 2019/0187622 A1 Jun. 20, 2019

(30) Foreign Application Priority Data

Dec. 19, 2017 (EP) ..... 17208379

(51) Int. Cl.
*G04B 29/02* (2006.01)

(52) U.S. Cl.
CPC ..... *G04B 29/022* (2013.01)

(58) Field of Classification Search
CPC ..... G04B 29/00–04; G04B 33/00–16
See application file for complete search history.

(56) References Cited

U.S. PATENT DOCUMENTS 674,712 A * 5/1901 Sandoz ..... G04B 18/023 368/172
1,436,743 A * 11/1922 Wild ..... G04B 29/04 368/300
2,192,169 A * 3/1940 Bulova ..... G04B 33/08 368/314
2,685,164 A * 8/1954 Grillet ..... G04B 29/00 368/318
4,023,348 A * 5/1977 Giger ..... G04B 29/02 368/88
4,534,660 A * 8/1985 Laesser ..... G04B 29/02 368/220

(Continued)

FOREIGN PATENT DOCUMENTS

CH 709 903 A2 1/2016
CN 105319944 A 2/2016

(Continued)

OTHER PUBLICATIONS

European Search Report dated Jun. 15, 2018 in European Application 17208379.2 filed on Dec. 19, 2017 (with English Translation of Categories of Cited Documents).

(Continued)

*Primary Examiner* — Daniel P Wicklund
(74) *Attorney, Agent, or Firm* — Oblon, McClelland, Maier & Neustadt, L.L.P.

(57) ABSTRACT

An adjustable timepiece assembly, including a base bar and an adjustable bar whose position is adjustable with respect to the base bar, parallel to a reference plane, the adjustable assembly includes a first part guided in rotation on a first pin integral with the base bar and which includes a first toothed sector meshing with a first adjustment pinion press fit in the base bar, and which is subjected to the return force exerted by a first return spring to take up play, and the adjustable bar is guided in rotation on a second pin integral with the first part, and includes a second toothed sector meshing with a second adjustment pinion press fit in the first part, the adjustable bar being subjected to the return force of a second return spring.

13 Claims, 2 Drawing Sheets

(56) References Cited

U.S. PATENT DOCUMENTS

| | | | | | |
|---|---|---|---|---|---|
| 4,603,978 | A * | 8/1986 | Brenk | G04B 29/00 | 368/309 |
| 5,369,627 | A * | 11/1994 | Ikegami | G04B 29/027 | 368/220 |
| 5,515,607 | A * | 5/1996 | Ikegami | G04B 13/02 | 29/893.34 |
| 2015/0212490 | A1* | 7/2015 | Cordier | G04B 18/02 | 368/170 |
| 2017/0336761 | A1* | 11/2017 | Lenoir | G04B 31/04 | |
| 2018/0017941 | A1* | 1/2018 | Semon | G04B 17/045 | |
| 2019/0187622 | A1* | 6/2019 | Feyer | G04B 29/022 | |
| 2020/0117142 | A1* | 4/2020 | Denden | G04B 19/04 | |

FOREIGN PATENT DOCUMENTS

| | | | |
|---|---|---|---|
| EP | 2 977 833 | A1 | 1/2016 |
| EP | 3 144 741 | A1 | 3/2017 |
| WO | WO 2013/139807 | A1 | 9/2013 |

OTHER PUBLICATIONS

Combined Chinese Office Action and Search Report dated Jun. 29, 2020 in Chinese Patent Application No. 201811541406.5 (with English translation and English translation of Category of Cited Documents), 13 pages.

* cited by examiner

ADJUSTABLE TIMEPIECE ASSEMBLY

CROSS-REFERENCE TO RELATED APPLICATION

This application claims priority to European Patent Application No. 17208379.2 filed on Dec. 19, 2017, the entire disclosure of which is hereby incorporated herein by reference.

FIELD OF THE INVENTION

The invention concerns an adjustable timepiece assembly, comprising a base bar or bridge and at least one adjustable bar or bridge whose position is adjustable with respect to said base bar, parallel to a reference plane.

The invention also concerns a timepiece movement including at least one such adjustable assembly.

The invention also concerns a timepiece, in particular a watch, including such a timepiece movement, and/or such an adjustable assembly.

The invention concerns the field of timepiece mechanisms.

BACKGROUND OF THE INVENTION

Certain timepiece wheel sets require high precision alignment of their two pivot points. When the latter pivot in two plates or bars separated by several bars, the accumulation of manufacturing tolerances can create a significant alignment error.

EP Patent No 3144741 in the name of Vaucher proposes a solution for adjusting the position of a pivot point of a bar. This adjustable bar includes a mounting member secured to a frame member of the movement. It further includes a first movable member connected to the preceding member by a first set of flexible joints allowing it to move along a first axis with respect to the mounting member, and a second movable member connected to the first movable member via a second set of flexible joints allowing the second movable member to move substantially along a second axis, perpendicular to the first axis, with respect to the first movable member, said second movable member carrying a timepiece element. The first movable member includes a first elongated slot perpendicular to the first axis and in which is positioned a head of a first eccentric rotatably mounted with an interference fit on a frame member of the movement. The second movable member includes a second elongated slot perpendicular to the second axis and in which is positioned a head of a second eccentric rotatably mounted with an interference fit on a frame member of the timepiece movement. The geometry of the bar is complex and therefore difficult to produce.

CH Patent No 707267 in the name of ETA discloses a timepiece mechanism comprising a reference timepiece wheel set forming a reference axis and an adjustable timepiece wheel set, one end of which having a guide surface is position adjustable with respect to said reference axis by means of a micrometric displacement mechanism which includes a guide member for receiving said guide surface, and micrometric displacement means arranged to move said guide member in a micrometric manner with respect to the reference axis, and which are controlled by adjustment means offset with respect to the reference axis and with respect to the guide member.

SUMMARY OF THE INVENTION

It is an object of the invention to overcome the problem of aligning two pivot points by adjusting a bar. It is desired that the solution is simple and that the bar can maintain a traditional aesthetic appearance.

To this end, the invention concerns an adjustable timepiece assembly according to claim 1.

The invention also concerns a timepiece movement including at least one such adjustable assembly.

The invention also concerns a timepiece, in particular a watch, including such a timepiece movement, and/or at least one such adjustable assembly.

BRIEF DESCRIPTION OF THE DRAWINGS

Other features and advantages of the invention will appear from reading the following detailed description, with reference to the annexed drawings, in which.

DETAILED DESCRIPTION OF PREFERRED EMBODIMENTS

Figure 1:
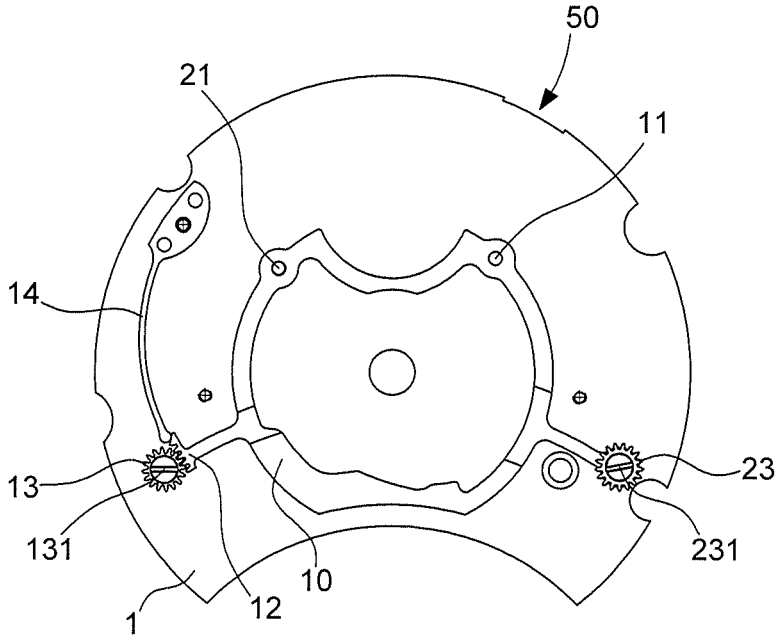
FIG. 1 represents a schematic plan view of a first level of an adjustable assembly according to the invention, comprising a first part pinned to a base bar and angularly adjustable with respect to its single pin through the cooperation between a first adjustment pinion press fit in the base bar and a first toothed sector comprised in said first part.

The invention concerns an adjustable timepiece assembly 50, comprising a base bar or bridge 1 and at least one adjustable bar or bridge 20 whose position is adjustable with respect to said base bar 1 parallel to a reference plane.

More particularly, base bar 1 and adjustable bar 20 are substantially plane and are arranged substantially parallel to each other, and the adjustment concerns their relative positioning with respect to one another in projection onto a reference plane, parallel to which base bar 1 extends.

The Figures illustrate a particular and non-limiting application wherein adjustable bar 20 carries a jewel 200, whose position must be precisely adjusted with respect to base bar 1.

A first part 10 is guided in rotation about a first pin 11 integral with base bar 1. This first part 10 also includes a first toothed sector 12, which meshes with a first adjustment pinion 13 press fit in base bar 1. First part 10 is loaded by a first return spring 14 to take up any play.

An adjustable bar 20 is guided in rotation about a second pin 21 integral with first part 10, and which is positioned away from first pin 11. A second toothed sector 22 integral with adjustable bar 20 meshes with a second adjustment pinion 23. This second adjustment pinion 23 is positioned away from first adjustment pinion 13 and advantageously as far away as possible.

Second adjustment pinion 23 is press fit in first part 10. "Press fit" means here and in the following description, that these components are mounted one inside the other with a light interference fit, with sufficient friction to prevent any relative pivoting during operation under vibrations or in the event of shocks, but weak enough to allow pivoting under torque imparted by a tool operated by a watch technician, such as a screwdriver or similar. The gripping at the diameter is comprised between 1 micrometre and 20 micrometres. More specifically but not exclusively, the gripping at the diameter is comprised between 4 micrometres and 18 micrometres. More specifically still, the gripping at the diameter is comprised between 8 micrometres and 16 micrometres. Adjustable bar 20 is loaded by a second return spring 24 to take up any play. Adjustable bar 20 is fixed to base bar 1 by at least one screw 25, and particularly two screws 25 in the variant illustrated by the Figures. Adjustable bar 20 rests on base bar 1 and not on first part 10.

A first direction formed by first pin 11 and first adjustment pinion 13 is secant to a second direction defined by second pin 21 and second adjustment pinion 23. Given the dimensions of the timepiece movement and the other components that it contains, the positioning of these pins and adjustment pinions is not entirely free, and it is important to stay as close as possible to a configuration in which this first direction and second direction are perpendicular, in order to facilitate adjustments. Preferably, these directions form between them an angle comprised between 60° and 90°. In the example embodiment illustrated by the Figures, these directions form an angle of approximately 60°. The definition of this angle is also the result a compromise with another constraint which requires maximising each of the distances between first pin 11 and first adjustment pinion 13 on the one hand, and second pin 21 and second adjustment pinion 23 on the other hand, in order to increase adjustment sensitivity as much as possible.

When screw or screws 25 of adjustable bar 20 are not fully screwed in, it is possible to move adjustable bar 20 (and thus, for example, a jewel bearing 200 press fit in adjustable bar 20) in two arcs close to two perpendicular lines, and thus to adjust the position of adjustable bar 20 along two axes. It is advantageous to provide each screw 25 with a friction spring 26, of the annular spring foil or similar type, arranged between adjustable bar 20 and base bar 1 around said screw 25, said friction spring 26 is arranged to immobilise adjustable bar 20 when screw 25 is loosened during the adjustment phase. When the two screws 25 are unscrewed to perform the adjustment, adjustable bar 20 does not move, which allows for precise adjustment.

With this solution, once the movement is completely assembled, the two pivot points can easily be aligned by adjusting adjustable bar 2 along two axes.

Thus, first pin 11 is also moved as far away as possible from first adjustment pinion 13 so that a very small rotation imparted to a first guide member 131 of first adjustment pinion 13, formed by a slot in the Figures, is transformed into an even smaller rotation of first part 10 with respect to first pin 11, which ensures a truly micrometric adjustment. The same applies to second pin 21 and second adjustment pinion 23, which includes a second guide member 231.

Figure 2:
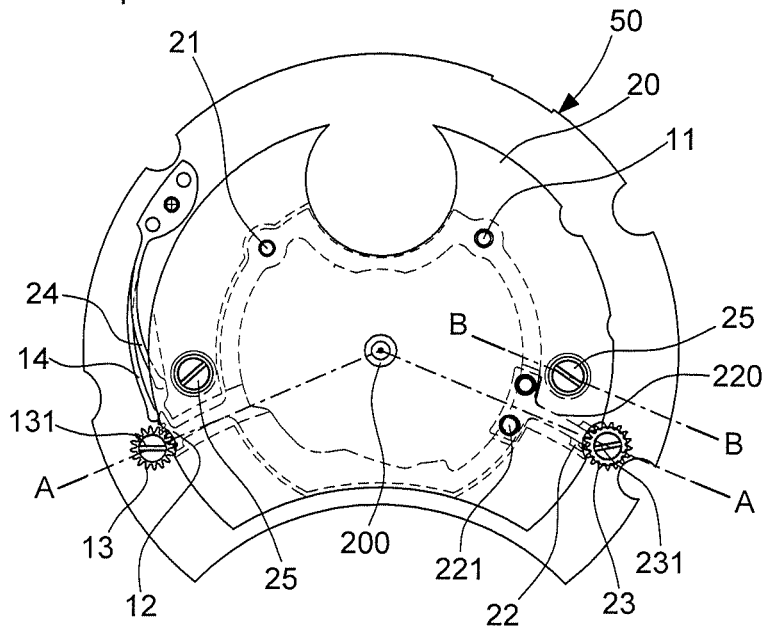
FIG. 2 represents, in a similar manner to FIG. 1, the entire adjustable assembly, which includes, on the upper level and above the first part of FIG. 1, an adjustable bar, which is pinned to said first part by another single pin, and which is also angularly adjustable with respect to its single pin through the cooperation between a second adjustment pinion press fit in the first part and a second toothed sector comprised in the adjustable bar.
Figure 3:
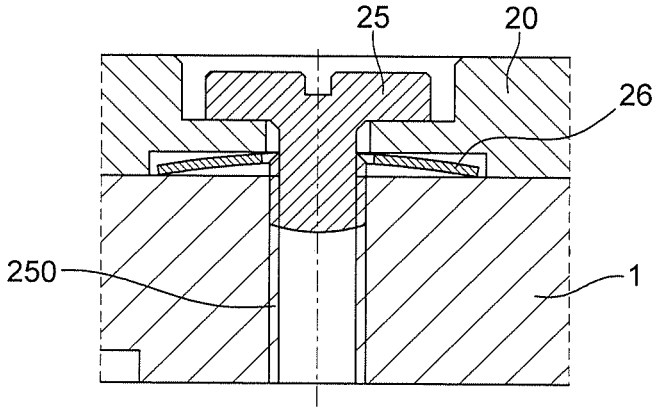
FIG. 3 is a detail section, on line B-B of FIG. 2, of the direct connection between the adjustment bar and the base bar.
Figure 4:
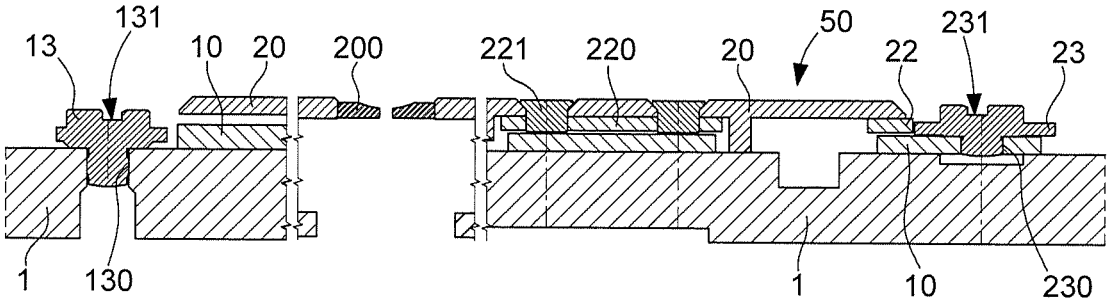
FIG. 4 is a section, on line A-A of FIG. 2, of the adjustable assembly according to the invention.
Figure 5:
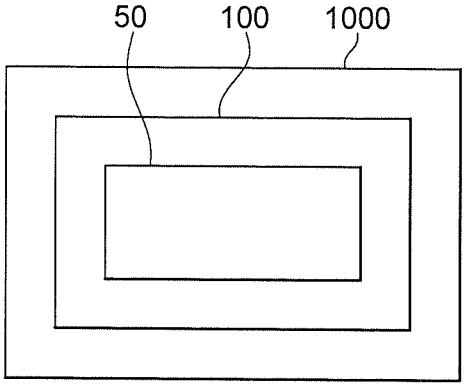
FIG. 5 is a block diagram representing a timepiece including a movement which in turn includes such an adjustable assembly.

FIG. 4 illustrates a section on AA of FIG. 2 and shows, from left to right:

first adjustment pinion 13 press fit in a housing 130, particularly a bore, of base bar 1; in the illustrated variant this press-fit is a light interference fit, action by the watch technician on slot 131 makes it possible to perform the adjustment. In another variant (not illustrated), the first adjustment pinion is stopped in an angular position by a jumper or suchlike. Naturally, the angular position of the first adjustment pinion can be calibrated to facilitate the work of the watch technician;

the superposition of adjustable bar 20, first part 10 and base bar 1;

a jewel 200 to be adjusted, press fit in adjustable bar 20;

the superposition of adjustable bar 20, provided with a rack 220 including second toothed sector 22 and secured by securing members 221, such as rivets or screws, or bonding or similar, first part 10 and base bar 1;

adjustable bar 20 bearing directly on base bar 1;

the cooperation between second toothed sector 22 and second adjustment pinion 23 press fit in a housing 230, particularly a bore, of first part 10, in a similar manner to first adjustment pinion 13.

FIG. 4 shows first part 10 positioned between base bar 1 and adjustable bar 20. It is understood that first part 10 can either bear on base bar 1, or be cantilevered on its single pivot pin 11, on a support of adequate dimensions.

In a variant, first part 10 is above adjustable bar 20 which bears on base bar 1, with adjustable pinion 23 thus underneath first part 10. Likewise, first part 10 can then either bear on adjustable bar 20 or be cantilevered on its single pivot pin 11.

Naturally, although the invention is illustrated, in a non-limiting manner, with a single adjustment level, it is clear that it is possible to extrapolate by arranging adjustable bar 20 in the same way as base bar 1—with a pin housing and an adjustment pinion housing—and forming a second level including a second part similar to first part 10, and with respect to which a second adjustable bar is adjustable. The series arrangement of such adjustable levels is limited only by the total thickness of the movement.

Similarly, in an advantageous manner, the same base bar 1 can serve, on both sides thereof, as support for two independent adjustment levels, one having a first upper part and an upper adjustable bar, and the other having a first lower part and a lower adjustable bar.

The invention also concerns a movement 100 including at least one such adjustable assembly 50.

The invention also concerns a timepiece 1000, in particular a watch, including at least one such movement 100 and/or including at least one such adjustable assembly 50.

The invention is of major interest to any timepiece mechanism requiring high precision between two pivot points, such as a split-seconds watch or similar.

The invention claimed is:

1. An adjustable timepiece assembly, comprising a base bar or bridge and at least one adjustable bar or bridge whose position is adjustable with respect to said base bar parallel to a reference plane, wherein said adjustable assembly comprises at least a first part which is guided in rotation about a first pin integral with said base bar, wherein said first part includes a first toothed sector, which meshes with a first adjustment pinion press fit in said base bar, and wherein said adjustable bar is guided in rotation about a second pin integral with said first part, and includes a second toothed sector which meshes with a second adjustment pinion press fit in said first part.

2. The adjustable assembly according to claim 1, wherein said first part is subjected to a return torque exerted by a first return spring to take up any play, and wherein said adjustable bar is subjected to a return torque exerted by a second return spring to take up any play.

3. The adjustable assembly according to claim 2, wherein a first direction formed by said first pin and said first adjustment pinion is secant to a second direction defined by said second pin and said second adjustment pinion, and forms therewith an angle comprised between 60° and 90°.

4. The adjustable assembly according to claim 3, wherein said adjustable bar is secured to said base bar by at least one screw, around which a friction spring, arranged between said adjustable bar and said first part is arranged to immobilise said adjustable bar when said screw is unscrewed in an adjustment phase.

5. The adjustable assembly according to claim 2, wherein said adjustable bar is secured to said base bar by at least one screw, around which a friction spring, arranged between said adjustable bar and said first part is arranged to immobilise said adjustable bar when said screw is unscrewed in an adjustment phase.

6. A movement comprising at least one adjustable assembly according to claim 2.

7. The adjustable assembly according to claim 1, wherein a first direction formed by said first pin and said first adjustment pinion is secant to a second direction defined by said second pin and said second adjustment pinion, and forms therewith an angle comprised between 60° and 90°.

8. The adjustable assembly according to claim 7, wherein said adjustable bar is secured to said base bar by at least one screw, around which a friction spring, arranged between said adjustable bar and said first part is arranged to immobilise said adjustable bar when said screw is unscrewed in an adjustment phase.

9. The adjustable assembly according to claim 1, wherein said adjustable bar is secured to said base bar by at least one screw, around which a friction spring, arranged between said adjustable bar and said first part is arranged to immobilise said adjustable bar when said screw is unscrewed in an adjustment phase.

10. A movement comprising at least one adjustable assembly according to claim 1.

11. A timepiece comprising at least one movement according to claim 1.

12. The timepiece according to the claim 11, wherein the timepiece is a watch.

13. The timepiece according to claim 12, wherein the timepiece is a fly-back chronograph.

* * * * *